United States Patent [19]

Hunkar et al.

[11] 4,202,247

[45] May 13, 1980

[54] CLOSED LOOP ELECTRO-FLUIDIC CONTROL SYSTEM

[75] Inventors: Denes B. Hunkar, Cincinnati; Hans Ortlepp, Loveland, both of Ohio

[73] Assignee: Hunkar Laboratories, Inc., Cincinnati, Ohio

[21] Appl. No.: 913,301

[22] Filed: Jun. 7, 1978

Related U.S. Application Data

[62] Division of Ser. No. 737,031, Oct. 29, 1976, Pat. No. 4,132,152.

[51] Int. Cl.[2] ..... F15B 13/16; F15B 13/044

[52] U.S. Cl. ..... 91/364; 91/459; 91/461

[58] Field of Search ..... 91/364, 363 R, 363 A, 91/361

[56] References Cited

U.S. PATENT DOCUMENTS

| | | | |
|---|---|---|---|
| 2,797,666 | 7/1957 | Chubbuck | 91/364 |
| 2,939,430 | 6/1960 | Westbury | 91/364 |
| 3,257,914 | 6/1966 | Thorner | 91/364 |
| 3,386,343 | 6/1968 | Gray | 91/364 |

FOREIGN PATENT DOCUMENTS

| | | | |
|---|---|---|---|
| 874559 | 4/1953 | Fed. Rep. of Germany | 91/364 |

*Primary Examiner*—Paul E. Maslousky
*Attorney, Agent, or Firm*—Wood, Herron & Evans

[57] ABSTRACT

Two embodiments of closed loop electro-fluidic controlled systems are disclosed for controlling the velocity, acceleration, torque, force of pressure applied to a member. The system includes a source of electrical command signals correlated to the desired magnitude of the parameter being controlled, a transducer responsive to the controlled member for providing an electrical feedback signal correlated to the actual value of the parameter, and a circuit for providing an error signal correlated in magnitude and polarity to the magnitude and sense of the difference between the actual and desired values of the controlled parameter. Also included is a transducer responsive to the error signal for applying a positioning force to a movable valve closure element, which is subjected to no other forces, to regulate the application of pressurized fluid through the valve to the controlled member in dependence upon the error signal. No feedback, mechanical, fluidic or otherwise, exists between the valve element and the transducer which positions it. An important advantage of the system is that the error signal is zero under steady state conditions when the actual and desired magnitude of the controlled parameter are equal nonzero values. In addition, electrical command offset signals and/or electrical integrators operating on the error signal and/or centering springs operating on the movable valve element are not required. Nor is feedback required between the movable valve element and the transducer which positions it.

7 Claims, 8 Drawing Figures

CLOSED LOOP ELECTRO-FLUIDIC CONTROL SYSTEM

This is a division of application Ser. No. 737,031, filed Oct. 29, 1976, now U.S. Pat. No. 4,132,152.

This invention relates to closed loop control systems and more particularly to electro-fluidic closed loop control systems for controlling the velocity, acceleration, force, torque or pressure applied to a member.

Closed loop control systems of the electro-fluidic type have existed for many years in a variety of different applications. Typically, existing prior art systems can generally be considered to fall into one or the other of two different categories. The first type of control system is utilized to control the position or location of a movable member, such as a tool slide of a lathe, which is periodically indexed from one position to another. In such systems a position command signal is generated by a programmer or the like indicating the position to which the movable member is to be driven, and a position feedback signal is generated by a position transducer which monitors the actual position of the tool slide. The signals reflecting desired and actual position are compared and a position error signal is generated reflecting the instantaneous difference between the desired and actual positions. This position error signal is then used to control an electro-hydraulic servovalve which applies pressurized fluid to drive the tool slide toward the desired position. When the movable member reaches the desired position, i.e., a steady state condition, the command position signal and the actual position signal become equal, and the position error signal returns to zero. When the steady state condition is reached, the electro-hydraulic servovalve, which is a valve having an hydraulic output at any instant of time correlated to the electrical input, ceases to apply pressurized fluid to the movable tool slide and it remains at the desired location to which it was driven.

Typically, the electro-hydraulic servovalve includes a first, or pilot, stage and a second, or power, stage. The pilot stage is usually of the movable jet tube or movable flapper variety. In either case, a nonzero error signal input to the pilot stage moves the jet pipe or flapper from its centered position, which it occupies when input with a zero position error signal, through a distance and in a direction which is a function of the magnitude and polarity of the nonzero position error signal. Displacement of the jet tube or flapper from its centered position applies a net hydraulic force to the movable valve element of the second or power stage, such as to the spool of a three-way valve. Spool movement causes pressurized fluid from a pump or the like to be applied through the valve to drive the member being controlled, i.e., the tool slide. When the driven tool slide reaches the desired position, the signals correlated to actual and desired position become equal, and the position error signal goes to zero. In turn, the jet tube or flapper of the pilot stage returns to its centered position, and the net force applied to the spool of the second stage valve by the pilot stage goes to zero.

Since the driven tool slide, once in the desired position, is not to be further moved (absent a change in position command signal), it is necessary to return the second stage spool to its centered position to terminate the application of pressure fluid from the pump to the tool slide through the second stage valve. To accomplish this prior art proposals have typically provided some form of mechanical or hydraulic feedback within the servovalve between the spool of the second stage and the flapper or jet tube of the pilot stage. This feedback within the servovalve operates such that when the jet tube returns to its centered position when the position error signal goes to zero, indicating that the desired and actual positions are the same, a force is applied by the feedback means from the pilot stage jet tube or flapper to the spool of the second stage to return the spool to its centered position.

The second type of electro-hydraulic closed loop control system, which also typically includes an electro-hydraulic servovalve, is utilized to control the velocity, acceleration, torque, force or pressure applied to a member. Applications of this type differ from positional control applications previously described in that once the control parameter, such as velocity, acceleration, torque, force or pressure, has reached the desired nonzero level, application of pressurized fluid through the second stage valve from the source of pressurized fluid must be maintained at some predetermined nonzero level correlated to the desired nonzero velocity, acceleration, torque, pressure or force level. In the past, when closed loop control systems using electro-hydraulic servovalves with feedback between the second stage spool and the pilot stage flapper or jet tube have been used to control velocity, acceleration, torque, pressure or force, special modifications have been required. The modifications are necessary, when steady state is reached at nonzero levels of velocity, etc. and the error signal to the pilot stage goes to zero and centers the jet tube or flapper, to maintain the spool of the second stage at some off-center position to provide for continued application of pressurized fluid to the controlled member to maintain it at the desired nonzero velocity, etc.

For example, in such prior proposals it has been necessary to provide circuit means for providing an error signal offset to produce a nonzero error signal under steady state conditions at nonzero levels of the controlled parameter, (e.g., velocity) to counteract the mechanical feedback between the second stage spool and first stage jet tube or flapper of the servovalve to hold the second stage valve spool off center when a steady state condition at a nonzero level is reached, that is, when the desired nonzero magnitude of the control parameter equals the actual nonzero value of the controlled parameter. Also required have been electrical integrating networks between the pilot stage and the error signal generating circuit to allow the error signal to return to zero without forcing the spool to return to its centered position.

Accordingly, it has been an objective of this invention to provide a reliable, simpler and more economical closed loop control system of the electro-fluidic type for controlling a member in those applications where under steady state conditions a continuing application of pressurized fluid to the controlled member is required, such as in controlling the velocity, acceleration, torque, force or pressure. In one embodiment of the invention, this objective has been accomplished in accordance with certain of the principles of this invention by providing, in a closed loop system which includes a source of command signals correlated in magnitude to the desired magnitude of the controlled parameter, a transducer for providing an electrical signal correlated to the instantaneous actual magnitude of the controlled parameter, and a circuit for providing an error signal correlated to the difference between the actual and desired magnitudes of the controlled parameter, the combination of (1) a three-way valve having a movable valve element for simultaneously altering the sizes of two valve openings, one of which is connected to a reservoir and the other to either a source of pressurized fluid or the controlled member the valve also being provided with a third opening connected to either (a) a source of pressurized fluid which occurs when one of the other two openings is connected to the controlled member or (b) the driven member which occurs when one of the other two openings is connected to a source of pressurized fluid, and (2) a transducer responsive to the error signal which applies a force to the movable valve element correlated to the magnitude of the error signal for applying pressurized fluid to the controlled member from the pressurized fluid source. In one preferred form of the invention the transducer which is responsive to the error signal may be of the electro-hydraulic jet tube or flapper type, and the valve may be a three-way spool valve of either the center closed or center open type.

In accordance with this invention, the movable valve closure element is acted on by no forces other than the transducer which responds to the error signal. Accordingly, when a steady state condition is reached, that is, when the desired and actual magnitudes of the controlled parameter are equalized at some nonzero value and the error signal input to the transducer is zero, the force applied by the transducer to the valve closure element is zero. Since the valve closure element is acted upon by no other forces, it remains in the position it was at the time the steady state condition was reached. With the valve element at rest in the position it occupied at the time the steady state condition was reached, the flow or application level of pressurized fluid to the controlled member present when steady state was reached continues and the magnitude of the controlled parameter, such as velocity, acceleration or the like, is maintained at the desired level.

An advantage of the system of this invention is that under steady state conditions when the desired and actual magnitudes of the control parameter are equalized at some nonzero value, the error signal input to the valve-controlling transducer is zero without need for utilization of electrical integrating networks between the valve-controlling transducer and the comparator responsive to the command and actual parameter signals which produces the error signal. In addition, mechanical or fluidic feedback between (a) the valve-controlling transducer, such as the pilot stage jet tube or flapper, and (b) the valve closure element, e.g., the second stage spool, is not required. Thus, both the electrical circuitry and the hardware of the electro-fluidic closed loop control system of this invention is simplified, producing a reduction in both initial equipment cost and maintenance.

These and other advantages, features and objectives of the invention will become more readily apparent from a detailed description of preferred embodiments thereof taken in conjunction with the drawings in which.

Figure 7:
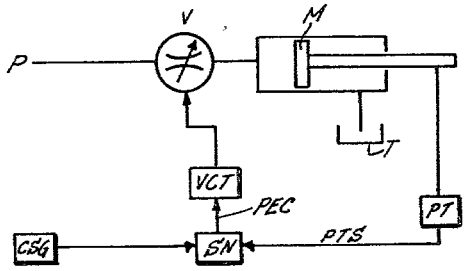
Figure 8:
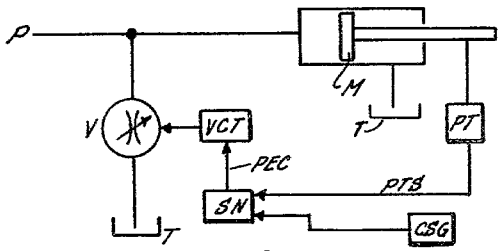

FIG. 7 is a schematic electro-hydraulic circuit diagram of the invention utilizing a two-way valve interconnected between a source of pressurized fluid and a translatable load member; and FIG. 8 is a schematic electro-hydraulic circuit diagram of the invention utilizing a two-way valve connected between a tank and a fluidic line interconnecting a source of pressurized fluid and a translatable load member.

The closed loop control system of this invention is useful in controlling movable members powered or driven with fluid, e.g., liquid or gas, in which the driven member is either rotatable or rectilinearly translatable. For example, the control system of this invention is useful in providing closed loop control of the angular velocity, or angular acceleration of the output shaft of a rotary pneumatic or hydraulic motor. The invention is also useful in providing closed loop control of the linear velocity or linear acceleration of a translatable movable member, such as a pneumatic or hydraulic piston. The invention is also useful in controlling the force applied to a moving piston. Finally, the invention is useful in controlling the torque applied to a rotary member, whether or not it is actually rotating as well as controlling the pressure applied to a translatable member in motion or at rest. The system of this invention is not, however, useful in closed loop control of the position or location of a movable member such as closed loop control of the position of a movable machine tool slide as often occurs in indexing tool slide from one specific location to another or through a specified distance. In such position or location control systems, when the movable member, e.g., tool slide, arrived at the desired location, application of a net fluidic pressure in one direction or the other to the slide being positioned or located must terminate; otherwise, the slide will continue movement beyond the desired location.

Figure 1:
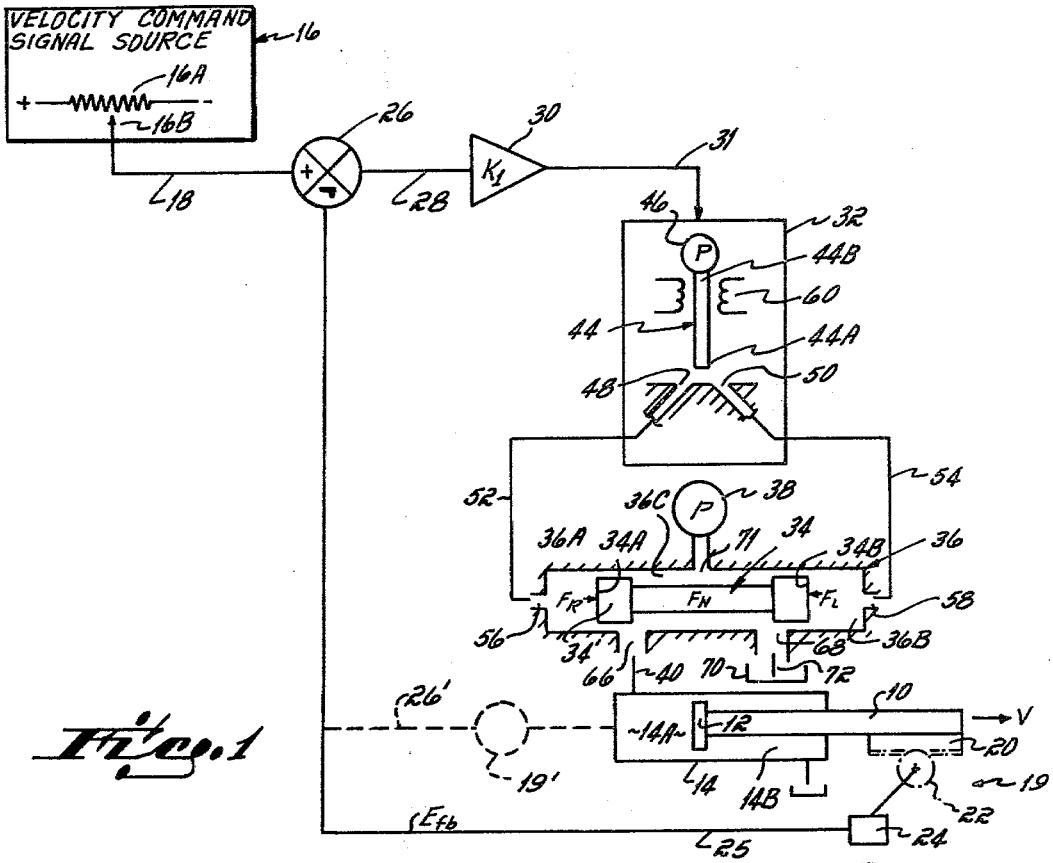
FIG. 1 is a composite electrical and fluidic circuit drawing in schematic form of one preferred embodiment of the invention for providing closed loop velocity control of a rectilinearly movable fluidically-driven piston.

FIG. 1 depicts one preferred embodiment of the invention which provides closed loop control of the velocity of a rectilinearly movable member, namely, a rectilinearly translatable shaft 10 rigidly secured to a piston 12 movable within a cylinder 14. While the embodiment depicted in FIG. 1 provides closed loop control of the linear velocity of the movable output shaft 10, the system could also be used to control the linear acceleration of the output shaft or the force (or pressure) applied to the moving output shaft, or the force (or pressure) applied to the output shaft via the piston 12 if the shaft is "dead headed", i.e., is not in motion.

The closed loop velocity control system, as shown in FIG. 1, includes a source of electrical command signals 16 correlated in magnitude to the velocity "V" at which it is desired to translate the rectilinearly movable output shaft 10. The source of velocity command signals 16 is schematically shown as a voltage divider 16A having a variable tap 16B which provides velocity command electrical signals on line 18 of variable magnitude depending on the position of the tap. Alternatively, the source of velocity command signals 16 could take the form of a velocity programmer of the type disclosed in Hunkar U.S. Pat. No. 3,712,772, issued Jan. 23, 1973, incorporated herein by reference, in which velocity command signals are provided which are selectively variable in magnitude as the function of the rectilinear position of the translatable driven member, such as the output shaft 10.

The velocity control system of FIG. 1 also includes a velocity transducer 19 responsive to the output shaft 10 for providing an electrical signal on line 26 correlated at any instant of time to the instantaneous velocity of the driven translatable shaft 10. In one form the velocity transducer includes a rack 20 secured to the output shaft 10 for movement therewith and an associated pinion 22 in meshing relationship with the rack 20 which is mounted for rotation about a stationary shaft. The linear motion of the output shaft 10 is translated to rotary motion of the pinion 22. The pinion 22 constitutes the input of a tachometer 24 which provides on the output line 25 an electrical signal having a magnitude which is a function of the linear velocity "V" of the output shaft 10 and constitutes a velocity feedback signal $E_{fb}$.

An arithmetic circuit 26, such as a summing network, is responsive to both the velocity feedback signal on line 25 and the velocity command signal on line 18. The arithmetic circuit 26 provides on its output line 28 an electrical signal correlated to the difference between the command velocity signal, or the desired velocity of the driven shaft 10, and the velocity feedback signal, or the actual velocity of the output shaft 10. The output on line 28 of the arithmetic circuit 26 at any given time, since it is correlated to the difference between the command and actual velocities, constitutes a velocity error signal.

The velocity error signal on line 28 is input via a suitable amplifier 30 having a gain $K_1$ to an electro-fluid transducer 32. The transducer 32 functions to apply a force $F_N$ to a movable valve closure element, such as a spool 34 of an open center three-way flow divider valve 36, which is correlated in magnitude to the magnitude of the velocity error signal such that pressurized fluid from a source of pressure fluid, e.g., a pump 38, flows through the flow divider valve 36 to the cylinder 14 via a fluidic line 40. The resultant flow to the cylinder 14 via the line 40 applies a force to the piston 12 for increasing the velocity of the output shaft 10. As the velocity of the output shaft 10 increases toward the desired level established by the velocity command source 16, the magnitude of the velocity feedback signal on line 25 approaches the magnitude of the command velocity signal on line 18. When the actual velocity of the shaft 10 equals the desired velocity, the velocity feedback and velocity command signals input to the arithmetic circuit on lines 25 and 18 are equal, providing a zero velocity error signal. A velocity error signal of zero, when input to the electro-fluidic transducer 32, provides a net force $F_N$ of zero on the spool 34. With a net force no longer being applied to the spool 34 by the transducer 32 and the spool not subjected to other forces (fluidic, mechanical spring, etc.), the spool 34 remains in the position to which it was driven in the process of creating the flow in line 40 to the cylinder 14 necessary to bring the output shaft 10 to the desired velocity.

The electro-fluidic transducer 32, in the form shown in FIG. 1, includes a jet tube 44 which is open at its lower end 44A and connected to a source of pilot pressure, such as a pilot pressure pump 46, at its upper end 44B. The jet tube 44 is pivotally mounted at its upper end for movement of its lower end 44A between first and second limits of travel aligned, respectively, with input ports 48 and 50 of fluidic lines 52 and 54. The other ends 56 and 58 of lines 52 and 54 communicate with opposite end regions 36A and 36B of the flow divider valve 36. The electro-fluidic transducer 32 includes a suitable electro-mechanical transducer 60 for pivoting the jet tube 44 in response to the error signal input thereto on line 31.

The electro-fluidic transducer 32 is in its centered position shown in FIG. 1 with its lower end 44A equidistant from the ports 48 and 50 when the error signal input to the electro-mechanical transducer 60 is zero. Under such circumstances the pressures produced in valve regions 36A and 36B which are transmitted through lines 52 and 54, respectively, are equal.

As the magnitude of the error signal input to transducer 32 increases from zero, the jet tube 44 pivots toward one or the other of the openings 48 or 50 depending upon the polarity of the error signal. If the error signal is such that the jet tube 44 pivots counterclockwise to bring jet tube lower end 44A closer to port 50 than to port 48, such as when it is desired to increase the velocity of the shaft 10 from either zero or from a lesser nonzero value, the pressure communicated via line 54 to valve region 36B exceeds the pressure transmitted to valve region 36A via line 52. Under such circumstances the force $F_L$ applied to the adjacent surface 34B of the spool 34 exceeds the force $F_R$ applied to the adjacent surface 34A of the spool, producing a net force $F_N$ in a leftwardly direction. The spool 34, in response to a net force $F_N$ in a leftwardly direction, shifts leftwardly, simultaneously closing valve port 68 and opening valve port 66, the former port being connected to a reservoir or tank 70 via line 72. The alteration in size of ports 66 and 68 as the spool 34 shifts leftwardly is in inverse relationship, with the size differential being dependent upon the magnitude of the error signal input to the electro-fluidic transducer 32. As the spool 34 shifts leftwardly a lesser flow of pressure fluid from the pump 38 entering the valve cavity 36C via opening 71 is diverted to the tank 70 by opening 68 in line 72 increasing the pressure communicated to cylinder chamber 14A via valve opening 66 and line 40. In addition, as the valve spool 34 shifts leftwardly the opening 66 becomes less restricted by the left spool land 34', throttling to a lesser extent flow between the line 40 and the valve cavity 36C which communicates with the source of pressure fluid 38. As a consequence of the foregoing effects of leftward movement of the spool 34, the force applied to the piston 12 and hence to the output shaft 10 increases, increasing the velocity of the output shaft.

When the velocity of the output shaft reaches the desired increased nonzero level established by the velocity command signal source 16 and the error signal input to the electro-fluidic transducer 32 decreases to zero, the jet pipe 44 returns to its centered position shown in FIG. 1, equalizing the forces $F_R$ and $F_L$ acting on opposite surfaces 34A and 34B of the spool 34, reducing the net force $F_N$ on the spool to zero. The spool remains in the new, more leftwardly position occupied at the time the velocity of the output shaft 10 reached the new, larger desired command velocity and the velocity of the output shaft is maintained at that desired larger value until a different command velocity is established by the velocity command signal source 16.

If it is now desired to decrease the actual velocity of the output shaft 10 from some existing nonzero actual velocity established by the velocity command signal source 16 to a lesser nonzero value, the command velocity signal on line 18 is decreased to the desired lesser nonzero value, causing an error signal to be produced by the arithmetic circuit 26. The magnitude of the error signal is proportional to the desired reduction in velocity and has a polarity opposite to that which results when it is desired to increase the actual velocity. This error signal is input to the electro-fluidic transducer 32, pivoting the jet tube 44 leftwardly, bringing jet tube output port 44A closer to port 48 than to port 50. This results in a greater pressure being transmitted to valve region 36A via line 52 than to region 36B via line 54. The rightward force $F_R$ now exceeds the leftward force $F_L$, producing a net force $F_N$ on the spool 34 in the rightward direction which shifts the spool 34 rightwardly.

Rightward movement of spool 34 simultaneously reduces the size of valve opening 66 while increasing the size of valve opening 68. This simultaneous decrease and increase in size of openings 66 and 68 diverts more pressure fluid from pump 38 to tank 70 via valve opening 68 and line 72 which in turn reduces the flow of pressure fluid via valve opening 66 and line 40 to the cylinder chamber 14A, in turn decreasing the velocity of the output shaft 10. When the actual velocity of the output shaft 10 reaches the desired new lesser nonzero value the velocity feedback signal on line 25 and the velocity command signal on line 18 becomes equal, providing a zero velocity error signal to the electro-fluidic transducer 32. The jet pipe 44 returns to its centered position equidistant from ports 48 and 50, equalizing the pressure in chambers 36A and 36B which in turn reduces to zero the net force $F_N$ on the spool 34. The spool remains in its new, noncentered, more rightwardly position corresponding to the new desired lesser nonzero velocity.

The foregoing two examples illustrate the operation of the embodiment of FIG. 1 when it is desired to increase the actual velocity of the output shaft 10 to a larger nonzero value and when it is desired to decrease the actual velocity of the output shaft to a smaller nonzero value. Specifically, the foregoing illustrations indicate the manner in which an error signal is generated to shift the spool 34 to a new steady state position whereafter the error signal returns to zero when the new desired nonzero velocity is reached, whether it be an increase or decrease with respect to the previous actual velocity.

The system of FIG. 1 can also produce an error signal to shift the spool 34 to a new position without a change in command velocity signal to a larger or smaller value occurring. Specifically, an error signal is created to shift the spool 34 to a new position absent a change in the command velocity signal when the actual velocity of the output 10 changes, either decreases or increases, due to an increase or decrease, respectively, in the loading on the output shaft. For example, if the actual velocity of the output shaft has reached the desired velocity established by command signal source 16 and the spool 34 has come to rest in a non-centered position as a consequence of a zero error signal, and thereafter without a change in the command velocity the output shaft loading increases, the output shaft velocity momentarily decreases. This reduction in actual velocity of the output shaft produces an error signal having a magnitude equal to the difference between command and actual velocity and of a polarity such that the jet tube 44 pivots counterclockwise to produce a net force $F_N$ on the spool 34 in a leftwardly direction to simultaneously increase the size of opening 66 and decrease the size of opening 68, diverting more pressurized fluid to cylinder 14A via line 40 and less to the tank 70 via line 72. The velocity of the output shaft now increases. When the actual velocity of the output shaft 10 returns to the desired command velocity existing prior to the sudden increase in resistance to shaft movement, the error signal returns to zero, the jet tube 44 centers, the net force $F_N$ on the spool 34 returns to zero, and the spool remains in its new more leftwardly position maintaining the actual velocity of the output shaft 10 at the unchanged desired command value notwithstanding an increase in resistance to shaft movement.

Should the resistance to movement of the output shaft decrease in the absence of an increase in command velocity from signal source 16, shaft velocity as well as the velocity feedback signal on line 25 would momentarily increase, producing a velocity error signal on line 28 of a polarity opposite from that produced in response to a sudden decrease in velocity due to increased shaft resistance. The magnitude of the error signal is correlated to the magnitude of the difference between the unchanged command velocity and the increased changed actual velocity. The velocity error signal input to the electro-fluidic transducer 32 shifts the jet tube 44 clockwise, providing a net rightwardly force $F_N$ to shift the spool rightwardly. This decreases the size of valve opening 66 and increases the size of valve opening 68, in turn diverting more pressurized fluid from the pump 38 to the tank 70 via line 72, causing the velocity of the output shaft 10 to decrease. When the actual velocity of the output shaft 10 decreases to its desired command value, the error signal returns to zero, the jet tube 44 centers, the net force $F_N$ on the spool returns to zero, and the spool remains at rest in its new more rightwardly position.

The righthand side 14B of the cylinder 14 exhausts fluid to a tank or reservoir 14C as the piston 12 moves rightwardly during the various control processes described above in connection with the FIG. 1 embodiment.

Movement of the member 10 in FIG. 1 can occur in a leftwardly direction, for example, in instances where the load acting on the movable member 10 is itself exerting a leftward force on the movable member 10. Such is common in the injection molding field where the movable member 10 is connected to a rotating injection screw which is urged in a leftwardly direction during plasticization when the injection screw rotates and accumulates material forward of the screw tip, which accumulated material when the injection screw is moved rightwardly is injected into the mold cavity as disclosed in Hunkar U.S. Pat. No. 3,712,772, incorporated herein by reference.

To facilitate leftward movement of the load member 10 at a predetermined velocity in situations of the type indicated above, a velocity command signal is input on line 18 which, in combination with the velocity feedback signal on line 25, produces a velocity error signal on line 28. The velocity error signal on line 28 after amplification is input on line 31 to the transducer 32 which via the winding 60 applies a force to the jet tube 44, moving the jet tube to the left. Leftward movement of the jet tube 44 is effective to apply a net differential force across the spool 34 in a rightwardly direction, moving the spool rightwardly, increasing the effective size of port 68 and decreasing the effective size of port 66. This in turn diverts more pressurized fluid from source 38 to tank 70 via port 68 in line 72 as well as increases throttling across port 66, reducing the pressure in chamber 14A applied to the piston 12 via port 66 and line 40, enabling the piston 12 to move leftwardly under the force of the externally applied load which is present in applications such as injection molding machines involving a rotating injection screw of the type disclosed in Hunkar U.S. Pat. No. 3,712,772.

Leftward movement of the piston 12 is accompanied by a flow of fluid from chamber 14A to tank 70 via line 40, port 66, central valve section 36C, port 68 and line 72. When the leftward velocity of the load member 10 reaches the desired value, the velocity feedback signal on line 25 equals the velocity command signal on line 18, causing the velocity error signal on line 28 to be reduced to zero. A zero velocity error signal, in the manner described previously, causes the jet tube 44 to return to its center position, placing a zero net force on the spool 34. The spool 34 remains where it is and the load member 10 continues moving leftwardly at the desired velocity.

Figure 2:
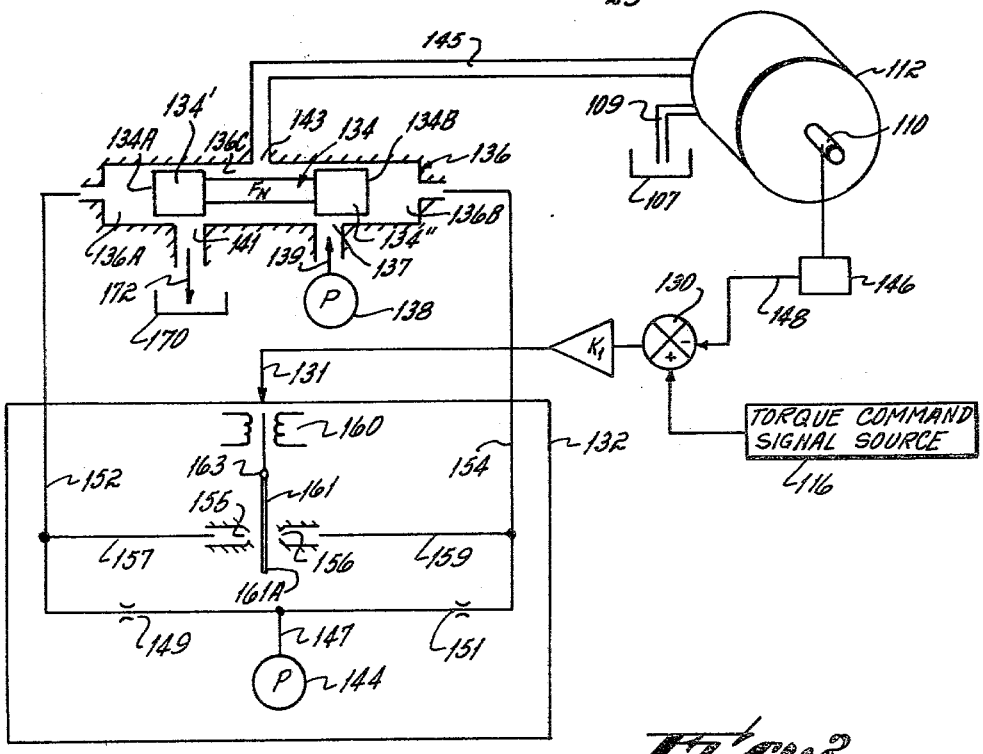
FIG. 2 is a composite electrical and fluidic circuit drawing in schematic form of another preferred embodiment of the invention for providing closed loop control of the rotational speed of a fluidically-driven motor.

In the embodiment depicted in FIG. 2 the closed loop control system of this invention is used to control a rotational member, such as the output shaft 110 of a rotary hydraulic motor 112. Control may be with respect to the angular velocity or angular acceleration or torque of the shaft 110. For purposes of illustration, torque is controlled by the closed loop system of this invention in the FIG. 2 embodiment.

Specifically, the system depicted in FIG. 2 includes a closed center three-way valve 136 of the throttle type having an axially shiftable spool 134 provided with left and right lands 134' and 134''. In the centered position, the spool 134 blocks substantially all flow, except for leakage, through the valve port 137 which is connected to a source of pressurized fluid 138 via line 139 and through valve port 141 which connects to a suitable reservoir or tank 170 via line 172. Located at opposite ends of the spool 134 are end surfaces 134A and 134B associated with valve cavities 136A and 136B. The valve 134 has a port 143 connected via line 145 to the input of the hydraulic motor 112. The hydraulic motor 112, which has a fluid exhaust port connected to a tank 107 via line 109, is of a conventional type in which the output shaft 110 rotates at a velocity correlated to the rate of flow of fluid input to the hydraulic motor via line 145. The output parameter of the hydraulic motor 110 being monitored, whether it be velocity, acceleration or torque, is monitored by a suitable transducer. In the embodiment of FIG. 2 wherein the output torque of the shaft 110 is being controlled, a suitable torque transducer 146 is used which provides on its output line 148 an electrical signal correlated to the output torque of hydraulic motor output shaft 110.

Associated with the flow divider valve 136 is a suitable electro-fluidic transducer 132. Transducer 132 is responsive to an amplified electrical error signal input thereto on line 131 generated by a summing network 130 which is correlated to the difference between the actual torque of the shaft 110 as monitored by the transducer 146 and the desired torque as provided by some suitable source of torque command signals 116 such as a programmer or the like, applies a net force $F_N$ on the spool 134 via fluidic lines 152 and 154. The magnitude and direction of the force $F_N$ is correlated to the magnitude and polarity of the torque error signal input to the electro-fluidic transducer 132 on line 131. The electro-fluidic transducer 132 includes a source of pilot pressure 144 which has its output 147 connected via suitable pressure-dropping orifices 149 and 151 to the fluidic lines 152 and 154 which communicate with the valve chambers 136A and 136B associated with the opposite spool end surfaces 134A and 134B. The electro-fluidic transducer 132 also includes a pair of opposed fluid exhaust orifices 155 and 156 which are connected to the lines 152 and 154 via lines 157 and 159. A movable member, or flapper, 161 is pivotally mounted as indicated by reference number 163 such that its lower end 161A moves between opposite limit positions adjacent exhaust orifices 155 and 156. An electro-mechanical transducer 160 responsive to the torque error signal input on line 131 pivots the flapper 161 in a direction and to an extent corresponding to the polarity and magnitude of the input torque error signal on line 131.

With a torque error signal equal to zero indicating that the actual torque and the desired torque, which may be nonzero, are equal, electro-mechanical transducer 160 applies no force to the flapper 161 and the flapper 161 remains in a centered position equidistant between the exhaust orifices 155 and 156. If there is a difference between the actual torque output of the hydraulic motor shaft 110 and a desired nonzero torque, a nonzero error signal, correlated in magnitude and polarity to the difference in extent and sense between actual and desired torque, will be input to the electro-fluidic transducer 132 on line 131. This error signal causes the electro-mechanical transducer 160 to pivot the flapper 161 in a direction and to an extent correlated to the magnitude and sense of the difference between desired and actual torque.

If the difference between desired and actual torque is such that the torque error signal input on line 131 results in the flapper 161 pivoting clockwise about mount 163 the lower end 161A of the flapper moves closer to the exhaust orifice 155 and further away from the exhaust orifice 156. As a consequence, the pressure in line 157 and hence in line 152 increases with respect to that in lines 159 and 154, causing the pressure in chamber 136A to exceed that in chamber 136B. The differential pressures existing in chambers 136A and 136B when applied to opposed surfaces 134A and 134B of the spool 134 cause the spool to shift rightwardly. As the spool shifts rightwardly the size of valve port 137 increases while that of port 141 decreases, reducing the throttling across port 137. This in turn causes fluid of increased pressure from the valve cavity 136C to be input to the hydraulic motor 112 via opening 137, valve chamber 136C, valve port 143 and line 145. The increase in pressure at the input to the hydraulic motor 112 due to rightward movement of the spool 134 applies a greater torque to the output shaft 110 of the motor. When the actual output torque of the motor 110 equals the desired torque the error signal input on line 131 returns to zero, returning flapper 161 to its centered position which in turn equalizes the pressures in chambers 136A and 136B, producing a zero net force $F_N$ on the spool. The spool remains in its off-center position with the port 134 partially open providing fluid to the hydraulic motor at a pressure correlated to the desired torque.

Should it be desired to decrease the actual output torque to a lower nonzero level, the torque command signal is reduced. This produces an error signal of a magnitude correlated to the difference between the actual and desired output torques, and of a polarity to pivot flapper 161 clockwise and shift the spool 134 leftwardly to increase the throttling at valve port 136. When the actual torque reaches the lesser, nonzero desired level, the torque error signal on line 131 returns to zero, the flapper 161 centers, and the spool comes to rest at the new, more leftwardly noncentered position.

In the FIG. 1 embodiment, if the shaft 10 is "dead headed", i.e., immovable, it is possible to use the closed loop control systems of this invention to maintain a predetermined selectively variable pressure on piston 12. Specifically, this is achieved by using the electrical signals output from the source 16 as pressure command signals and by substituting a pressure transducer 19', such as a diaphram and strain gauge device, responsive to the fluidic pressure in cylinder cavity 14A, for the velocity transducer 19, as shown in dotted lines in FIG. 1. The pressure transducer 19' provides an electrical output on line 26' to the arithmetic circuit 26 which produces on its output line 28, pressure error signals correlated in magnitude and polarity to the magnitude and sense of the difference between the actual pressure set by the pressure command signal source. The pressure error signal functions to maintain the actual pressure in cavity 14A which is applied to piston 12 and shaft 10 at the desired level in a manner analogous to that in which the desired velocity was maintained as previously discussed. In similar fashion the embodiment of FIG. 2 can be used to maintain at a desired command level the pressure in line 145 applied to a utilization device.

Significantly, in the embodiment of FIG. 1, the steady state error signal at nonzero velocities is zero, that is, when the velocity of the output shaft 10 has reached the desired, nonzero level established by the nonzero velocity command signal source 16, the error signal input to the electro-fluidic transducer 32 is zero. Moreover, zero steady state error signal at nonzero levels of the controlled parameter, e.g., velocity, is achieved without need for electrical integrating circuit component between the summing circuit 26 and the electro-fluidic transducer 32, as is necessary in closed loop systems using servovalves having feedback between the second stage valve spool and the first stage jet tube (or flapper). Specifically, and to a first order approximation, the net force $F_N$ applied to the spool 34 by the electro-fluidic transducer 32, which is responsive to the zero error signal under conditions of controlled parameter, (e.g., velocity) magnitudes which are nonzero, is also at zero magnitude. Since the spool 34 is subjected to a zero net force from the transducer 32 and is not subjected to any other forces (fluidic, mechanical or otherwise) tending to return it to a centered position, the spool 34 remains in a non-centered position, facilitating the flow of pressure fluid from the pump 38 through the valve 34 to the cylinder 14 via line 40 at a level sufficient to maintain the controlled parameter, e.g, velocity, of the output shaft 10 at the desired nonzero level established by the velocity command signal source 16 even though the error signal is zero. As noted, the foregoing condition of zero steady state error signal at nonzero magnitudes of the controlled parameter is achieved without electrical integrators and/or error signal offsets.

In addition, it is noteworthy that there is no feedback, mechanical, fluidic or otherwise, between the spool 34 and the jet tube tending to return the spool to its centered position when the desired velocity is reached and the jet tube has returned to its centered position upon decrease of the velocity error signal to zero as a consequence of the desired and actual velocities becoming equal.

The foregoing aspects of the structure and operation of the FIG. 1 embodiment also apply to the embodiment of FIG. 2. Specifically, in the FIG. 2 embodiment the steady state error signal at nonzero torques is zero, that is, when the torque on shaft 110 reaches the desired nonzero level established by the nonzero torque command signal source (not shown), the torque error signal input to the transducer 132 is zero. There is also no need for electrical integration circuit components between the summing circuit and the electro-fluidic transducer 132 to provide a zero steady state error signal at nonzero steady state torque levels as is necessary in closed loop control systems using electro-hydraulic servovalves. With zero steady state error signal at nonzero steady state torque levels the flapper 161 is centered. With the flapper 161 centered, the net force $F_N$ applied to spool 134 by transducer 132, which is responsive to the zero error signal, is also at zero magnitude. Since the spool 134 is subjected to a zero net force from transducer 132 and is not subjected to any other force (fluidic, mechanical or otherwise) tending to return it to a centered position, the spool 134 remains noncentered, facilitating the flow of pressure fluid from the pump 138 through port 137, cavity 136C, port 143 and line 145 to the input of motor 112 at a level sufficient to maintain the torque of the output shaft 110 at the desired nonzero steady state level established by the torque command signal source even though the steady state error signal is zero. As noted, the foregoing condition of zero steady state error signal at nonzero steady state torque levels is achieved without electrical integrators. In addition, it is noteworthy that there is no feedback, mechanical, fluidic or otherwise, between spool 134 and flapper 161 tending to return the spool to its centered position when the desired steady state nonzero level of torque is reached and the flapper 161 has returned to its centered position upon decrease of the torque error signal to zero steady state value as a consequence equalization of the desired and actual nonzero torque magnitudes.

In addition to using electro-fluidic transducers 32 and 132 to position the spools 34 and 134, electro-mechanical transducers could be used. For example, linear solenoids having their movable armatures mechanically connected to the spools and their electrical inputs connected to receive the error signals, could be used.

Figure 3:
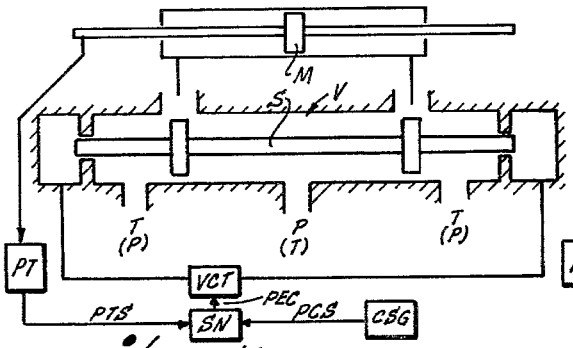
FIG. 3 is a schematic electro-hydraulic circuit diagram of the invention utilizing an open-center four-way valve having a spool with two lands.

FIG. 3 depicts a further embodiment of the invention in which a conventional open-center four-way fluidic valve with a two-land spool S is utilized. The position of the spool S is controlled by a valve controlling transducer VCT which is responsive to the parameter error signal PES (e.g., velocity error signal) generated by a summing network SN which is input with a parameter command signal PCS from a command signal generator CSG and a parameter transducer signal PTS from a parameter transducer PT which monitors the parameter of the movable member M being controlled. In the embodiment of FIG. 3 the ports of the spool valve V which are connected to the pressurized fluid source P and to tank T can be interchanged.

Figure 4:
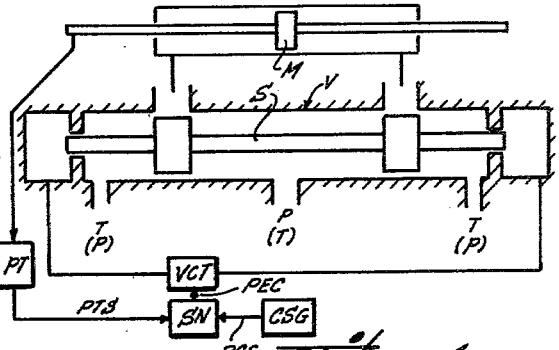
FIG. 4 is a schematic electro-hydraulic circuit diagram of the invention utilizing a closed-center four-way valve having a spool with two lands.

FIG. 4 shows an electro-hydraulic arrangement similar to FIG. 3, except the valve is a closed-center four-way valve with a two land spool.

Figure 5:
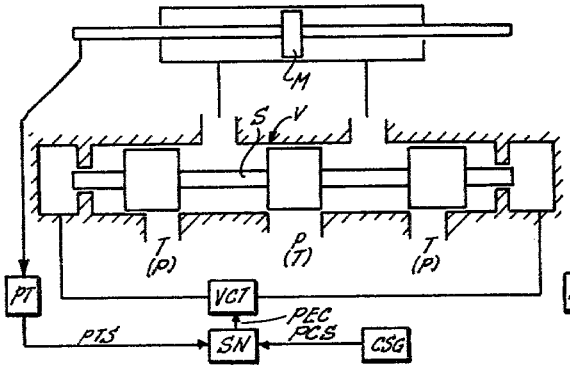
FIG. 5 is a schematic electro-hydraulic circuit diagram of the invention utilizing a closed-center four-way valve having a spool with three lands.
Figure 6:
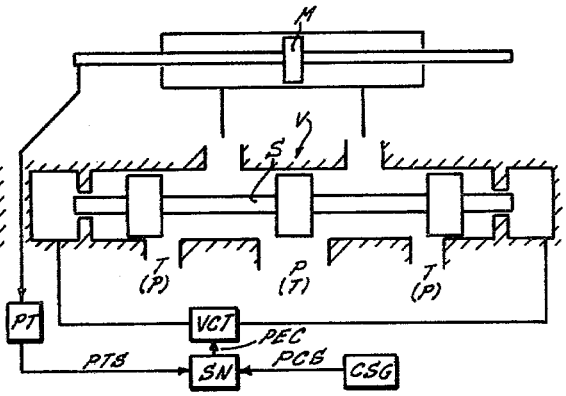
FIG. 6 is a schematic electro-hydraulic circuit diagram of the invention utilizing an open-center four-way valve having a spool with three lands.

FIGS. 5 and 6 depict the invention utilized with threeland spool/four-way valves of the closed-center and open-center types, respectively. Again, the ports of the spool valve connected to the source of pressurized fluid and to the tank can be interchanged.

In the valve of FIG. 5, as is seen from the drawing thereof, the center and left lands of the spool S cooperate with the center and left openings, respectively, to form first and second throttle valves, respectively. When the spool S shifts axially, e.g., leftwardly, it varies in direct relationship the respective sizes of the center and left openings, which, in turn, directly varies the throttling action of the first and second throttle valves.

FIG. 7 shows the invention utilized with a two-way valve V interconnected between a source of pressurized fluid P and a translatable load member M for the purpose of throttling to varying degrees pressurized fluid from the source P to the load in accordance with the magnitude of the parameter error signal PES.

In the electro-hydraulic circuit of FIG. 8 a two-way valve V is connected between tank T and a fluid line which interconnects a source of pressurized fluid P to a translatable load member M. The two-way valve V in the embodiment of FIG. 8 diverts flow of pressurized fluid from the pressurized fluid source P to tank T in varying amounts to vary the pressure applied to the load member M in accordance with the magnitude of the parameter error signal PES.

In each of the embodiments of FIGS. 3–8, as well as the embodiments of FIGS. 1 and 2, no feedback (mechanical, fluidic or otherwise) exists between the valve-controlling transducer (e.g., jet tube, flapper, etc.) and the movable valve element (e.g., spool) of the fluidic valve. In addition, there is no electrical integrating network between the summing network which produces the parameter error signal and the valve-controlling transducer. Further, in each of the embodiments of FIGS. 3–8 there is, to a first order approximation, a zero steady state error signal at nonzero steady state values of the controlled parameter. Finally, each embodiment includes a valve having at least two ports with a movable valve element responsive to the valve-controlling transducer for varying the size of at least one of the ports when moved, to in turn vary the pressure applied to the load member, the valve closure element having one position in which substantially no net pressure is applied to the load member and another position in which a net pressure is applied to the load member.

We claim:

1. A closed loop electro-fluidic control system for controlling the velocity of a movable member induced by the application of pressurized fluid to said member, said system having a zero steady state error signal for nonzero steady state controlled velocities, comprising:

a source of analog d.c. electrical signals correlated to a desired velocity of said movable member, velocity transducing means responsive to movement of said member for providing analog d.c. electrical signals correlated to the instantaneous actual velocity of said member, nonintegrating circuit means responsive to said desired velocity and actual velocity signals for providing an analog d.c. velocity error signal correlated to the instantaneous difference between said desired and actual velocities of said movable member, said error signal being zero when said desired and actual velocity signals have equal nonzero magnitudes, a valve having a first opening connected to a source of pressurized fluid, a second opening connected to provide fluid flow to said movable member in varying degrees, a third opening connected to a reservoir, a movable valve closure element, said valve closure element having first and second surfaces, said valve closure element being movable between first and second limits of travel when subjected to a differential fluidic force across said first and second surfaces to simultaneously vary in direct relationship the sizes of said first and third valve openings to extents dependent on the variable position of said valve closure element relative to said first and third openings, an electro-fluidic transducer responsive to said analog d.c. velocity error signal for producing a differential fluidic force across said first and second surfaces correlated in magnitude to said error signal, said electro-fluidic transducer providing a zero magnitude differential fluidic force across said first and second surfaces of said valve closure element when said velocity error signal has zero magnitude under conditions where said desired and actual velocities have equal nonzero magnitudes, said valve closure element having a predetermined position intermediate said first and second limits of travel wherein substantially no fluidic flow paths exist between said second opening and each of said first and third openings, and said valve closure element and said electro-fluidic transducer having no interconnection therebetween to return said valve closure element to said predetermined position when said velocity error signal is zero, said valve closure element being subjected solely to forces from said electro-fluidic transducer and remaining displaced from said predetermined position in the absence of force applied thereto by said electro-fluidic transducer once displaced therefrom by forces applied by said electro-fluidic transducer in response to a nonzero error signal input to said electro-fluidic transducer which has subsequently returned to zero upon reaching steady state.

2. The apparatus of claim 1 wherein said valve closure element is an axially shiftable spool, said spool having first and second lands cooperating with said first and third openings, respectively, to form first and second throttle valves, respectively, said spool producing direct variation in the respective sizes of said first and third openings when said spool shifts axially, wherein said first and second surfaces are associated with said first and second lands, respectively, and wherein said electro-fluidic transducer includes first and second pressurized fluidic outputs connected to subject said first and second spool surfaces to said differential fluidic force in response to said error signal input to said electro-fluidic transducer.

3. A closed loop electro-fluidic control system for controlling the magnitude of a parameter of a movable member at a nonzero value, which parameter at said nonzero value requires for maintenance thereof at said nonzero value the continuing application of pressurized fluid to said movable member, said system having a zero steady state error signal at nonzero steady state magnitudes of said controlled parameter, said system comprising:

a source of analog d.c. electrical signals correlated to a desired magnitude of said parameter of said movable member, transducing means responsive to said parameter of said member being controlled for providing analog d.c. electrical signal correlated to the instantaneous actual magnitude of said parameter of said movable member, nonintegrating circuit means responsive to said desired parameter and actual parameter analog d.c. signals for providing an analog d.c. parameter error signal correlated to the instantaneous difference between said desired and actual magnitudes of said parameter of said movable member, said error signal being zero when said desired and actual parameter signals have equal nonzero magnitudes, a valve having a first opening connected to a source of pressurized fluid, a second opening connected to provide fluid flow to said movable member in varying degrees, a third opening connected to a reservoir, and movable valve closure element, said valve closure element having first and second surfaces, said valve closure element being movable between first and second limits of travel when subjected to a differential fluidic force across said first and second surfaces to simultaneously vary in direct relationship the sizes of said first and third valve openings to extents dependent on the variable position of said valve closure element relative to said first and third openings, an electro-fluidic transducer responsive to said analog d.c. parameter error signal for producing a differential fluidic force across said first and second surfaces correlated in magnitude to said error signal, said electro-fluidic transducer providing a zero magnitude differential fuidic force across said first and second surfaces of said valve closure element when said parameter error signal has zero magnitude under conditions where said desired and actual magnitudes of said parameter have equal nonzero values, said valve closure element having a predetermined position intermediate said first and second limits of travel wherein substantially no fluidic flow paths simultaneously exist between said second opening and each of said first and third openings, and said valve closure element and said electro-fluidic transducer having no interconnection therebetween to return said valve closure element to said predetermined position when said parameter error signal is zero, said valve closure elememt being subjected solely to forces from said electro-fluidic transducer and remaining displaced from said predetermined position in the absence of force applied thereto by said electro-fluidic transducer once displaced therefrom by forces applied by said electro-fluidic transducer in response to a nonzero error signal input to said electro-fluidic transducer which has subsequently returned to zero upon reaching steady state.

4. The system of claim 3 wherein said valve closure element is an axially shiftable spool, said spool having first and second lands cooperating with said first and third openings, respectively, to form first and second throttle valves, respectively, said spool producing direct variation in the respective sizes of said first and third openings when said spool shifts axially, wherein said first and second surfaces are associated with said first and second lands, respectively, and wherein said electro-fluidic transducer includes first and second pressurized fluidic outputs connected to subject said first and second spool surfaces to said differential fluidic force in response to said error signal input to said electro-fluidic transducer.

5. A closed loop electro-fluidic control system for controlling the magnitude of a parameter of a movable member at a nonzero value, which parameter at said nonzero value requires for maintenance thereof at said nonzero value the continuing application of pressurized fluid to said movable member, said system having a zero steady state error signal at nonzero steady state magnitudes of said controlled parameter, said system comprising:

a source of analog d.c. electrical signals correlated to a desired magnitude of said parameter of said movable member, transducing means responsive to said parameter of said member being controlled for providing analog d.c. electrical signals correlated to the instantaneous actual magnitude of said parameter of said movable member, nonintegrating circuit means responsive to said desired parameter and actual parameter analog d.c. signals for providing an analog d.c. parameter error signal correlated to the instantaneous difference between said desired and actual magnitudes of said parameter of said movable member, said error signal being zero when said desired and actual parameter signals have equal nonzero magnitudes, a valve having a first opening connected to a source of pressurized fluid, a second opening connected to provide fluid flow to said movable member in varying degrees, a third opening connected to a reservoir, and a movable valve closure element, said valve closure element having first and second surfaces, said valve closure element being movable between first and second limits of travel when subjected to a differential fluidic force across said first and second surfaces to simultaneously vary in direct relationship the sizes of said first and third valve openings to extends dependent on the variable position of said valve closure element relative to said first and third openings, a valve-controlling transducer responsive to said analog d.c. parameter error signal for producing a differential force across said first and second surfaces correlated in magnitude to said error signal, said valve-controlling transducer providing a zero magnitude differential force across said first and second surfaces of said valve closure element when said parameter error signal has zero magnitude under conditions where said desired and actual magnitudes of said parameter have equal nonzero values, said valve closure element having a predetermined position intermediate said first and second limits of travel wherein substantially no fluidic flow paths simultaneously exist between said second opening and each of said first and third openings, and said valve closure element and said valve-controlling transducer having no interconnection therebetween to return said valve closure element to said predetermined position when said parameter error signal is zero, said valve closure element being subjected solely to forces from said valve-controlling transducer and remaining displaced from said predetermined position in the absence of force applied thereto by said valve-controlling transducer once displaced therefrom by forces applied by said valve-controlling transducer in response to a nonzero error signal input to said valve-controlling transducer which has subsequently returned to zero upon reaching steady state.

6. The apparatus of claim 5 wherein said valve closure element is an axially shiftable spool, said spool having first and second lands cooperating with said first and third openings, respectively, to form first and second throttle valves, respectively, said spool producing direct variation in the respective sizes of said first and third openings when said spool shifts axially, wherein said first and second surfaces are associated with said first and second lands, respectively, and wherein said valve-controlling transducer includes first and second outputs connected to subject said first and second spool surfaces to said differential force in response to said error signal input to said valve-controlling transducer.

7. A closed loop electro-fluidic control system for controlling the magnitude of fluidic pressure applied to a member at a nonzero value, which nonzero pressure value requires for maintenance thereof at said nonzero value the continuing application of pressurized fluid to said member, said system having a zero steady state error signal at nonzero steady state magnitudes of pressure, said system comprising:

a source of analog d.c. electrical signals correlated to a desired magnitude of pressure applied to said member, transducing means responsive to the actual pressure applied to said member for providing analog d.c. electrical signals correlated to the instantaneous actual magnitude of pressure applied to said member, nonintegrating electrical circuit means responsive to said desired presssure and actual pressure analog d.c. signals for providing an analog d.c. pressure error signal correlated to the instantaneous difference between said desired and actual magnitudes of said pressure applied to said member, said error signal being zero when said desired and actual pressure signals have equal nonzero magnitudes, a valve having a first opening connected to a source of pressurized fluid, a second opening connected to provide fluid flow to said member in varying degrees, a third opening connected to a reservoir, and a movable valve closure element, said valve closure element having first and second surfaces, said valve closure element being movable between first and second limits of travel when subjected to a differential fluidic force across said first and second surfaces to simultaneously vary in direct relationship the sizes of said first and third valve openings to extents dependent on the variable position of said valve closure element relative to said first and third openings, a valve-controlling transducer responsive to said analog d.c. pressure error signal for producing a differential force across said first and second surfaces correlated in magnitude to said error signal, said valve-controlling transducer providing a zero magnitude differential force across said first and second surfaces of said valve closure element when said analog d.c. pressure error signal has zero magnitude under conditions where said desired and actual magnitudes of said pressure has equal nonzero values, said valve closure element having a predetermined position intermediate said first and second limits of travel wherein substantially no fluidic flow paths simultaneously exist between said second opening and each of said first and third openings, and said valve closure element and said valve-controlling transducer having no interconnection therebetween to return said valve closure element to said predetermined position when said pressure error signal is zero, said valve closure element being subjected solely to forces from said valve-controlling transducer and remaining displaced from said predetermined position in the absence of force applied thereto by said valve-controlling transducer once displaced therefrom by forces applied by said valve-controlling transducer is response to a nonzero error signal input to said valve-controlling transducer which has subsequently returned to zero upon reaching steady state.

* * * * *